US005900866A

United States Patent [19]

McDaniel et al.

[11] Patent Number: 5,900,866

[45] Date of Patent: May 4, 1999

[54] METHOD AND SYSTEM FOR PROVIDING VIDEO GRAPHICS ADAPTER FUNCTIONALITY ON A SIMPLE FRAME BUFFER

[75] Inventors: Michael D. McDaniel, Redmond, Wash.; James W. Osborne, San Jose, Calif.

[73] Assignee: Apple Computer, Inc., Cupertino, Calif.

[21] Appl. No.: 08/613,675

[22] Filed: Mar. 11, 1996

[51] Int. Cl.[6] ..... G09G 5/24

[52] U.S. Cl. ..... 345/194; 345/471; 345/509; 345/192; 345/141

[58] Field of Search ..... 345/132, 141, 345/189, 199, 509, 147, 115, 113, 192, 471, 194, 507

[56] References Cited

U.S. PATENT DOCUMENTS

| | | | |
|---|---|---|---|
| 5,041,918 | 8/1991 | Ishida et al. | 358/442 |
| 5,293,313 | 3/1994 | Cecil et al. | 345/147 |
| 5,355,449 | 10/1994 | Lung et al. | 345/143 |
| 5,488,393 | 1/1996 | Wood et al. | 345/199 |
| 5,509,115 | 4/1996 | Butterfield et al. | 345/418 |
| 5,598,525 | 1/1997 | Nally et al. | 345/115 |

OTHER PUBLICATIONS

Insignia Solutions, Inc., "SoftWindows 95 and 3.0 for Power Macintosh are Here!", Internet publication (U.R.L.: http//www.insignia.com/marcom/30_upgrade/announce30–95.html).

Insignia Solutions, Inc., "Insignia Solutions Ships SoftWindows 95 with TurboStart for power Macintosh", Internet publication (U.R.L.: http//www.insignia.com/marcom/PressReleases/Mac_Power_Mac_products/PMac95_FIN–3–25–96.html).

Insignia Solutions, Inc.. "Insignia Solutions Ships 35% Faster SoftWindows 3.0 for Power Macintosh", Internet publication (U.R.L.: http//www.insignia.com/marcom/PressReleases/Mac_Power_Mac_products/PMac_3_0_FIN_3–25–96.html).

Insignia Solutions, Inc., "Guide to Choosing the Right Cross–Platform Solution for the Power Mac", Internet publication (U.R.L.: http//www.insignia.com/marcom/DataSheets/SW_30Mac_Card_Comparison.html).

Insignia Solutions, Inc., "SoftWindows 95 for Power Macintosh–Software that lets you run Windows 95 applications on your Power Macintosh", Internet publication (U.R.L.: http//www.insignia.com/marcom/Datasheets/SoftWindows_95Mac_DataSheet.html).

Insignia Solutions, Inc., "SoftWindows 3.0 for Power Macintosh" Internet publication (U.R.L.: http//www.insignia.com/marcom/DataSheets/SoftWindows_30Mac_DataSheet.html).

Insignia Solutions, Inc., "Guide to Choosing the Right Cross–Platform Solution for the Power Mac", Internet publication (U.R.L.: http//www.insignia.com/marcom/DataSheets/SW_95Mac_Card_Comparison.html).

*Primary Examiner*—Richard A. Hjerpe
*Assistant Examiner*—Kent Chang
*Attorney, Agent, or Firm*—Beyer & Weaver, LLP

[57] ABSTRACT

A display system conversion technique that provides text-mode (e.g., VGA mode) display capabilities to a computer system that lacks text-mode display hardware is disclosed. By using the display conversion technique, programs which assume or require text-mode display hardware can be made to operate properly on computer systems that lack such text-mode display hardware. According to one implementation, a display system for a computer system having an operating system, includes: a display device for displaying an image, a frame buffer for storing a bitmap of the image, a display driver for causing the bitmap to be forwarded to and displayed on the display device, and a text-mode-to-bitmap conversion system for converting text characters received from the operating system operating in a text-mode to the bitmap of the image which is stored in the frame buffer.

14 Claims, 9 Drawing Sheets

METHOD AND SYSTEM FOR PROVIDING VIDEO GRAPHICS ADAPTER FUNCTIONALITY ON A SIMPLE FRAME BUFFER

BACKGROUND OF THE INVENTION

1. Field of the Invention

The present invention relates to a display system and, more particularly, to a display system for a computer system.

2. Description of the Related Art

Many computer systems, such as IBM compatible personal computers, use a Video Graphics Adapter (VGA) graphics standard, which defines many different graphics modes, including text modes and bitmapped modes. Certain application programs or operating system programs require that a display system be set to a particular one of these modes. One such program is the operating system program referred to as NetWare produced by Novell Corporation of Provo, Utah. NetWare requires that the display system operate in a VGA mode, i.e., controlled by a VGA device.

Unfortunately, some computer systems, such as Apple Macintosh computers, do not support the VGA graphics standard because they do not have any VGA hardware. These computer systems (i.e., Macintosh computer systems) can only operate their display system in a bitmapped fashion. As a result, the NetWare operating system will not operate on such computer systems.

Thus, there is a need to enable computer systems which have a display system that lacks VGA functionality to properly execute programs that require the display system operate in a VGA mode.

SUMMARY OF THE INVENTION

A display system conversion technique that provides text-mode (e.g., VGA mode) display capabilities to a computer system that lacks text-mode display hardware is disclosed. By using the display conversion technique, programs which assume or require text-mode display hardware can be made to operate properly on computer systems that lack such text-mode display hardware. The invention can be implemented numerous ways, including as a system or method. Several representative embodiments of the invention are described below.

As a display system for a computer system having an operating system, an embodiment of the invention includes: a display device for displaying an image, a frame buffer for storing a bitmap of the image, a display driver for causing the bitmap to be forwarded to and displayed on the display device, and a text-mode-to-bitmap conversion system for converting text characters received from the operating system operating in the text-mode to a bitmap of the image which is stored in the frame buffer.

As a display system having pixel-based display hardware but not character-based display hardware, an embodiment of the invention includes: a display screen for displaying an image, a frame buffer for storing bit data of the image, a character buffer for storing the characters being displayed on the display screen, receive means for receiving a display command to display a character on the display screen, update means for updating the character buffer in accordance with the character identified by the display command, retrieval means for obtaining a character bitmap for the character, and merge means for merging the bit data of the character bitmap with the bit data in the frame buffer.

As a computer-implemented method for providing character-based functionality for a display system that lacks character-based display hardware, the display system including a frame buffer and a display screen, an embodiment of the invention includes the operations of: providing a character buffer for storing the characters being displayed on the display screen, receiving a display command to display a character on the display screen of the display system, updating the character buffer in accordance with the character identified by the display command, obtaining a character bitmap for the character, and storing the bits of the character bitmap at appropriate addresses in the frame buffer.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

Embodiments of the invention are discussed below with reference to FIGS. 1–7B. However, those skilled in the art will readily appreciate that the detailed description given herein with respect to these figures is for explanatory purposes as the invention extends beyond these limited embodiments.

A display system for a computer system typically includes a display device such as a cathode ray tube (CRT), a frame buffer (or pixel grid), and a color look-up table. The frame buffer and the color look-up table are typically connected to an input/output (I/O) bus which in turn connects to a controller (microprocessor). The image to be represented on the display screen is stored in the frame buffer. The bit pattern (or pixels) corresponding to the image stored in the frame buffer are read out of the frame buffer and displayed on the display device at the refresh rate. The color look-up table is provided so that an image can be displayed in color without having to require a very large frame buffer. Hence, the display of a pixel on the display device begins by first obtaining a corresponding entry in a frame buffer and then using this entry to obtain the appropriate color entry in the color look-up table which is then forwarded to the display device for display thereon.

The present invention provides Video Graphics Adapter (VGA) functionality to a display system that does not include VGA hardware. The VGA functionality provided by the invention is not full VGA compatibility, but limited compatibility, which is all that is required in most cases. Namely, in most cases, the degree of compatibility need not be complete because application programs or operating systems executing on a computer system lacking VGA hardware only require compatibility with a few of the functional features of VGA to operate properly. In the exemplary embodiments of the invention discussed below, it is assumed that the required functional features of VGA for limited compatibility include an 80×25 character grid (read/write); 9×15 IBM character set font; sixteen (16) foreground colors; eight (8) background colors; flashing text; and multiple cursors.

Figure 1:
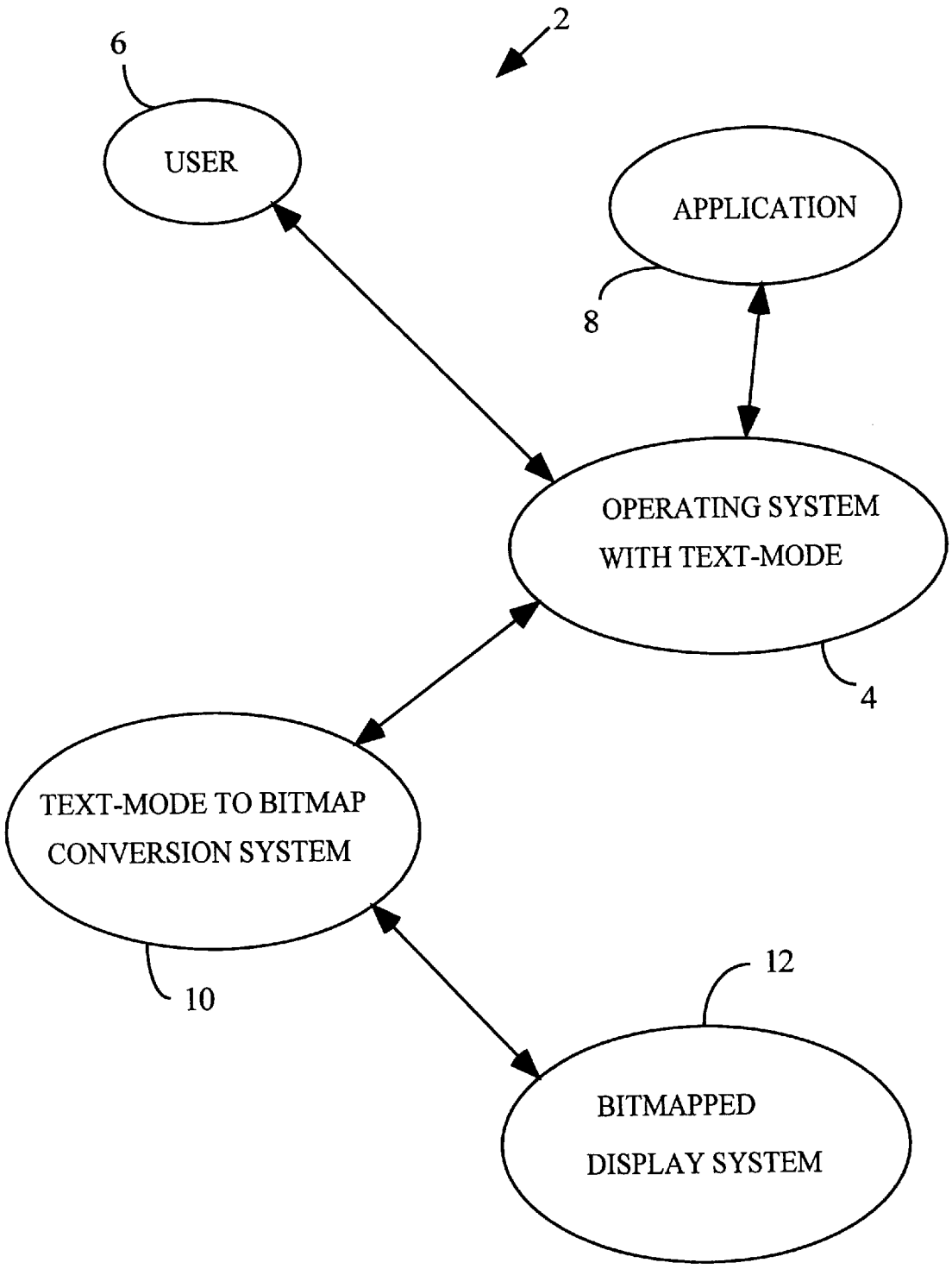
FIG. 1 is a functional diagram of a computer system according to an embodiment of the invention.

FIG. 1 is a functional diagram of a computer system 2 according to an embodiment of the invention. The computer system 2 includes an operating system 4 with a text-mode requirement. That is, the operating system is capable of operating in a text-mode and requires that the display system of the computer system support the text-mode. A text-mode is a mode in which a program (e.g., the operating system) sends character codes corresponding to text to a display system for display thereon. The text-mode is in essence a VGA-mode.

The operating system 4 interacts with a user 6 and an application 8 in conventional ways. The operating system 4 also interacts using a text-mode to a text-mode-to-bitmap conversion system 10 which is placed between the operating system 4 and a bitmapped display system 12. The text-mode-to-bitmap conversion system 10 operates to convert the text-mode (i.e., character codes) to a bitmap format so as to be useable on the bitmapped display system 12, yet appears to the operating system 4 or the application 8 as having a display system that supports text-mode (i.e., VGA).

Figure 2:
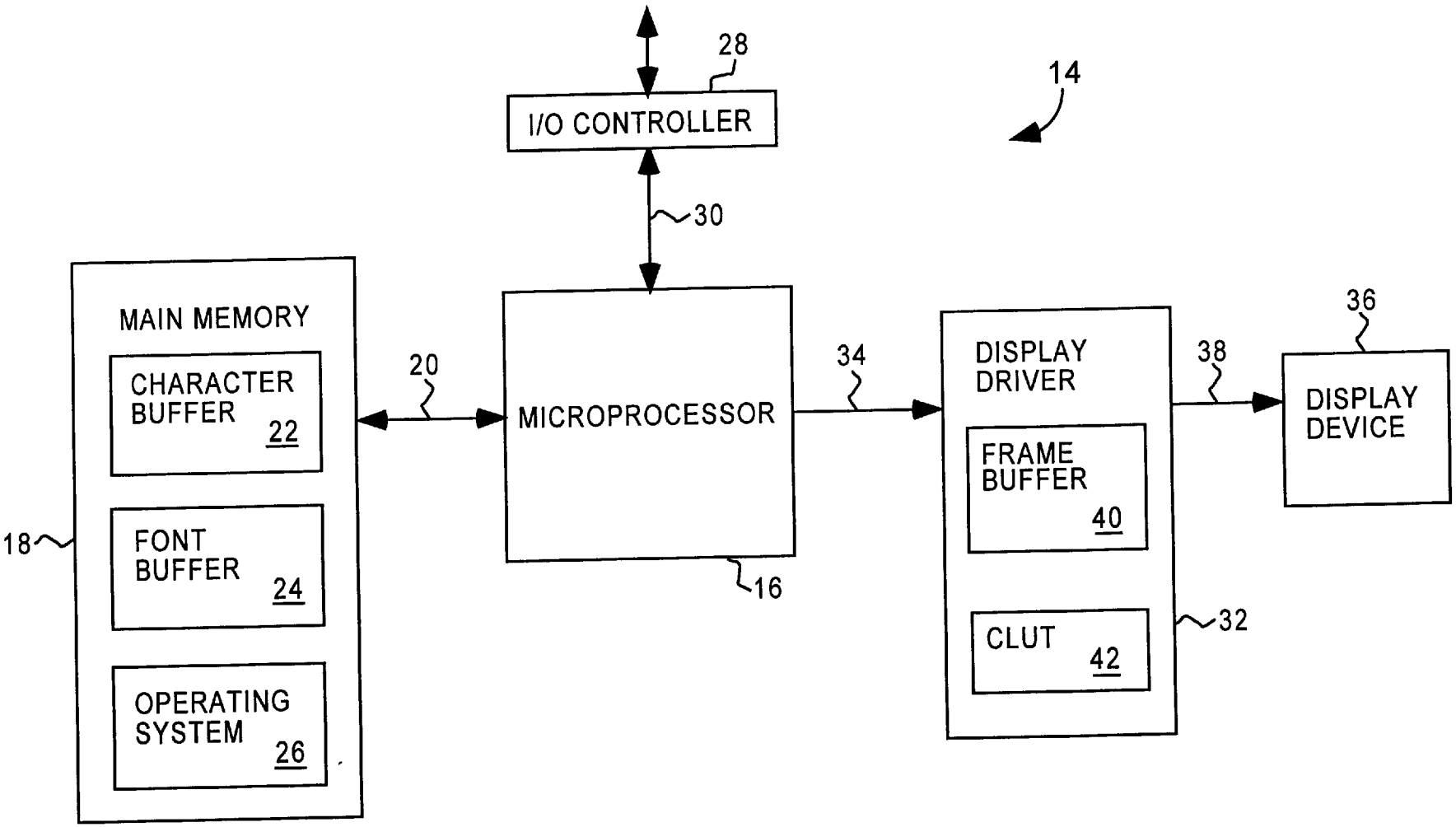
FIG. 2 is a simplified block diagram of a computer system in accordance with an embodiment of the invention.

FIG. 2 is a simplified block diagram of a computer system 14 in accordance with an embodiment of the invention. The computer system 14 includes a microprocessor 16 which controls the overall operation of the computer system 14. The computer system 14 also includes a main memory 18 which is coupled to the microprocessor 16 via a memory bus 20. The main memory 18 includes a character buffer 22, a font buffer 24 and an operating system 26. The microprocessor 16 is also coupled to an input/output (I/O) controller 28 through a I/O bus 30. The I/O controller 28 then in turn couples to various peripheral devices (not shown) such as disk drives, printers, network connections and the like. The microprocessor 16 is further coupled to a display driver 32 through a display bus 34. The display bus 34 and the I/O bus 30 can be one and the same bus. The display driver 32 is also coupled to a display device 36 (e.g., CRT) through a bus 38. The display driver 32 includes a frame buffer 40 and a color look-up table (CLUT) 42. The operations of the computer system 14 concerning the invention are described in detail below. However, it should be noted that the memory storage devices (the character buffer 22, the font buffer 24, the frame buffer 40 and CLUT 42) illustrated in FIG. 2 need not be located were indicated in FIG. 2. Instead, these memory storages may be combined in many different ways and located in many different locations within the computer system 14.

Figure 3:
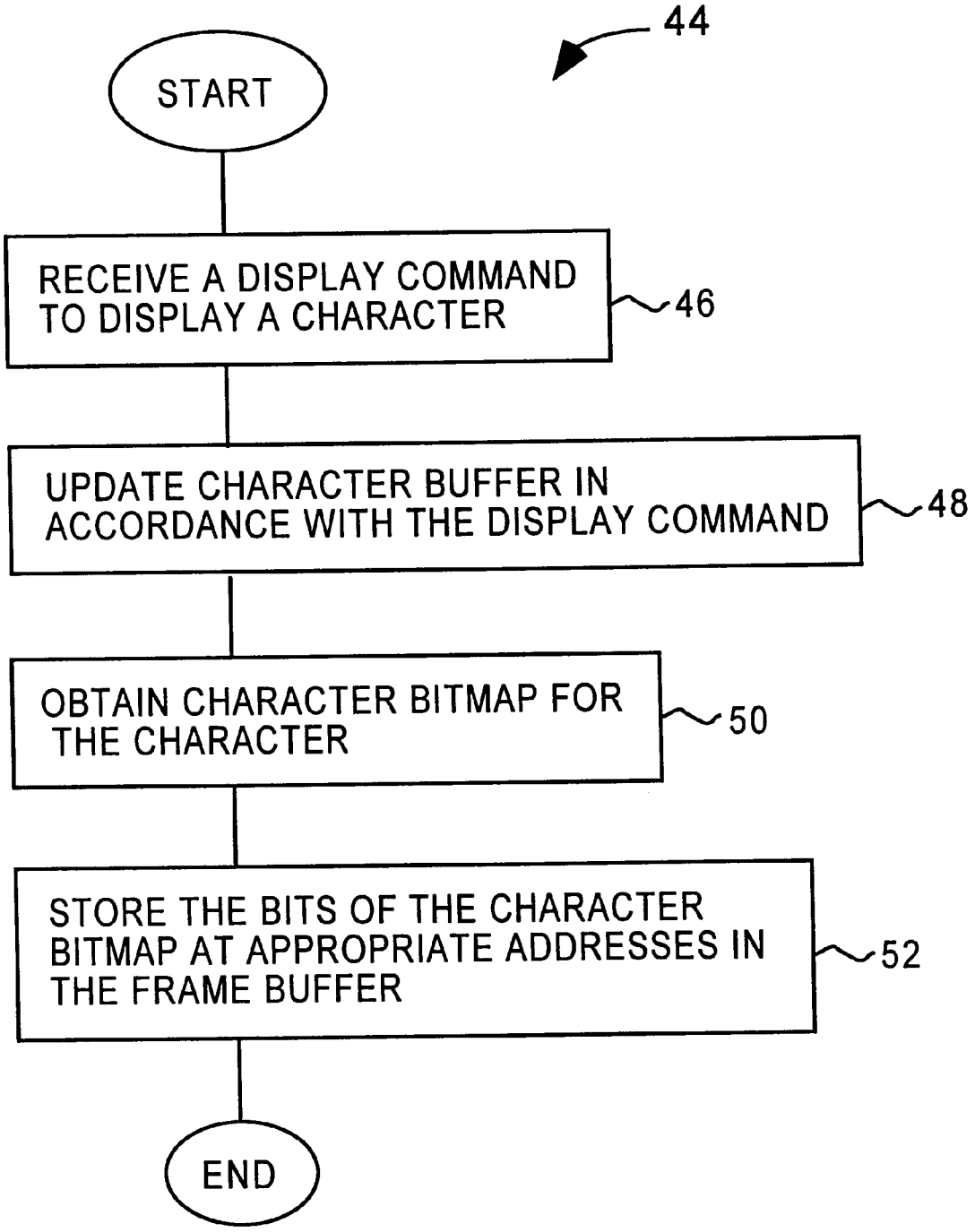
FIG. 3 is a flowchart of conversion processing according to an embodiment of the invention.

FIG. 3 is a flowchart of conversion processing 44 according to an embodiment of the invention. The conversion processing 44 is preferably carried out by the computer system 14 illustrated in FIG. 2. Hence, the conversion processing 44 is discussed with reference to the computer system 14.

Initially, a display command to display a character is received 46. Preferably, the operating system 26 of the computer system 14 will send a display command to the display driver 32 requesting that a character be displayed on the display device 36. For example, if the operating system 26 is the NetWare operating system, then a display command could, for example, be "Draw 'H' at position 1, 1 with attributes 0×07".

Next, the character buffer is updated 48 in accordance with the display command. Here, preferably with respect to FIG. 2, the character buffer 22 within the main memory 18 is updated so that the character to be displayed is represented and stored at the proper location within the character buffer 22. For example, if the display command is to display an "H" at row 7, column 10 on the display device 36, then the character "H" is stored into the character buffer 22 at a location corresponding to row 7, column 107. For example, in FIG. 4A, a character buffer 54 is illustrated having 25 rows (rows 0–24) and 80 columns (columns 0–79), with a character "H" 56 being positioned at row 7, column 10 therein. Since the character buffer 22 is typically implemented by contiguous memory locations, the location (or address) for the character is determined by: (row×width+column), where the row and column are provided by the display command and the width would be 80 in this example.

Figure 4A:
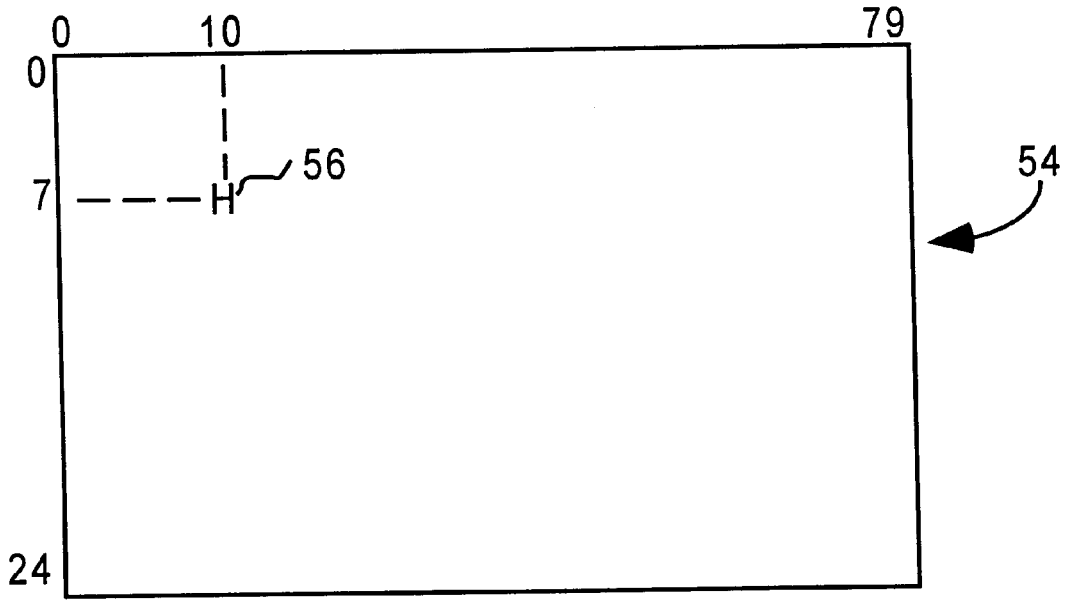
FIG. 4A is a exemplary diagram of a character buffer having a character "H" being positioned therein.
Figure 4B:
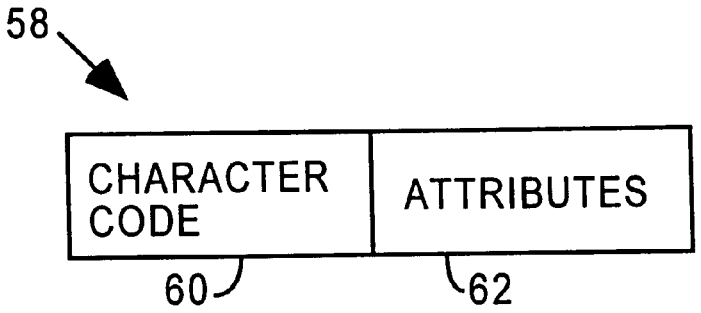
FIG. 4B is an exemplary data structure for each location within the character buffer of FIG. 4A.

Further, in FIG. 4B, an exemplary data structure 58 for each location (entry) within the character buffer 54 is illustrated. The data structure 58 includes a character code 60 and attributes 62 for the character code. The character code 60 is preferably the ASCII code value for the character 56. The attributes 62 include, for example, a foreground color and a background color for the character 56. The first bit in the attributes 62 can also be used to designate whether the character corresponding to the associated character code 60 is to "flash."

Figure 5:
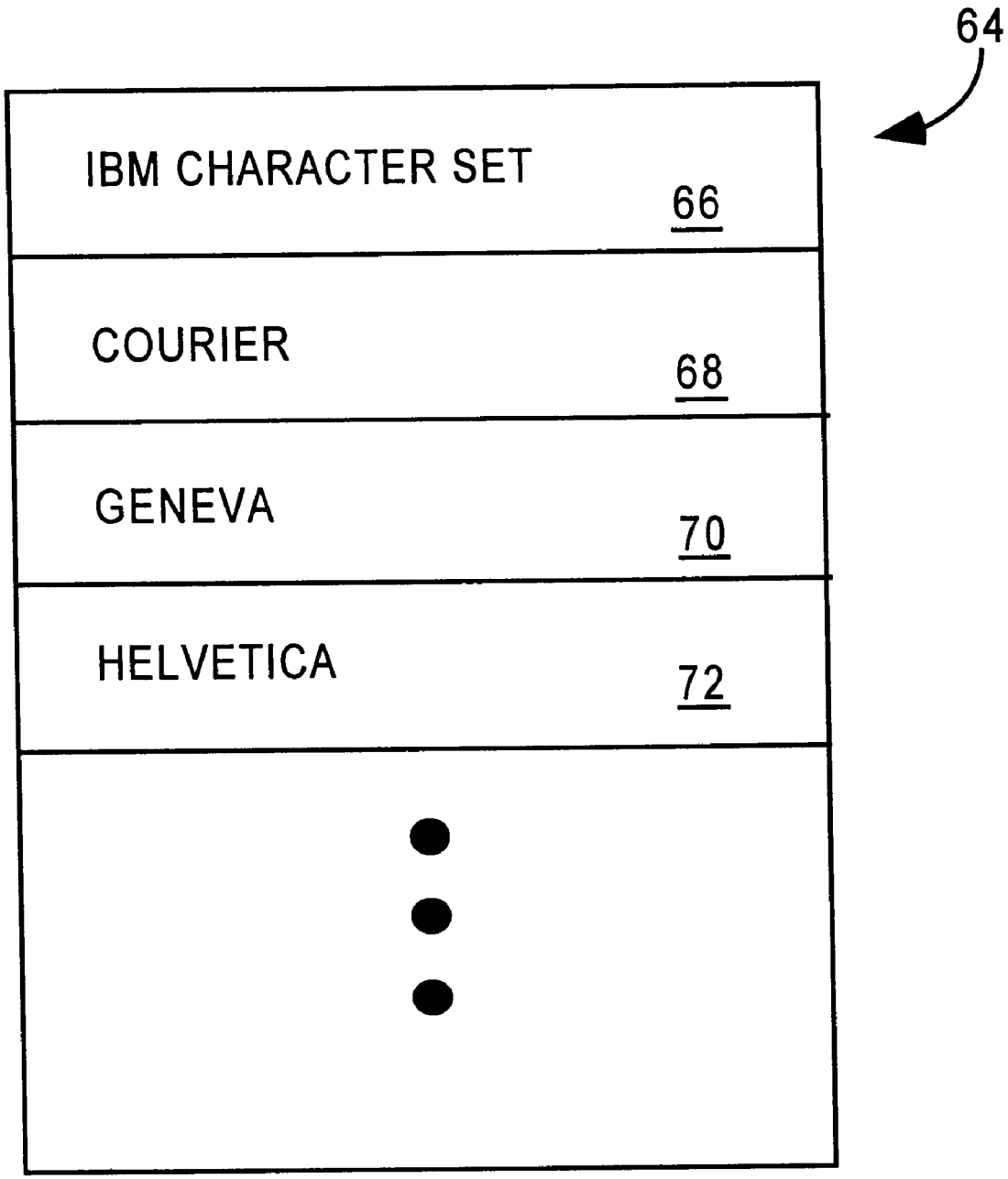
FIG. 5 illustrates an exemplary structure for a font buffer.

Next in the conversion processing 44, a character bitmap for the character to be displayed is obtained 50. Preferably, with respect to FIG. 2, the character bitmap for the character is obtained 50 from the font buffer 24. FIG. 5 illustrates an exemplary structure for a font buffer 64 that is suitable for use as the font buffer 24. The font buffer 64 is capable of storing bitmaps for individual characters of a particular font. As an example, the font buffer 64 illustrated in FIG. 5 includes a first region 66 storing IBM character set fonts, a second section 68 storing Courier fonts, a third section 70 storing Geneva fonts, and a fourth section 72 storing Helvetica fonts. The font buffer 64 may store bitmaps for individual characters of any of a number of different fonts as is desired.

Returning to FIG. 3, the conversion processing 44 then stores 52 the bits of the character bitmap at appropriate addresses in the frame buffer. Here, with respect to FIG. 2, the character bitmap obtained from the font buffer 24 for the character within the display command is placed in the frame buffer 40 at the appropriate addresses so that when the display device 36 is next refreshed using the data stored within the frame buffer 40, the character that has been requested to be displayed by the display command will be properly displayed on the display device 36. A preferred implementation of the store operation 52 is explained in more detail below with reference to FIGS. 7A and 7B.

Figure 6A:
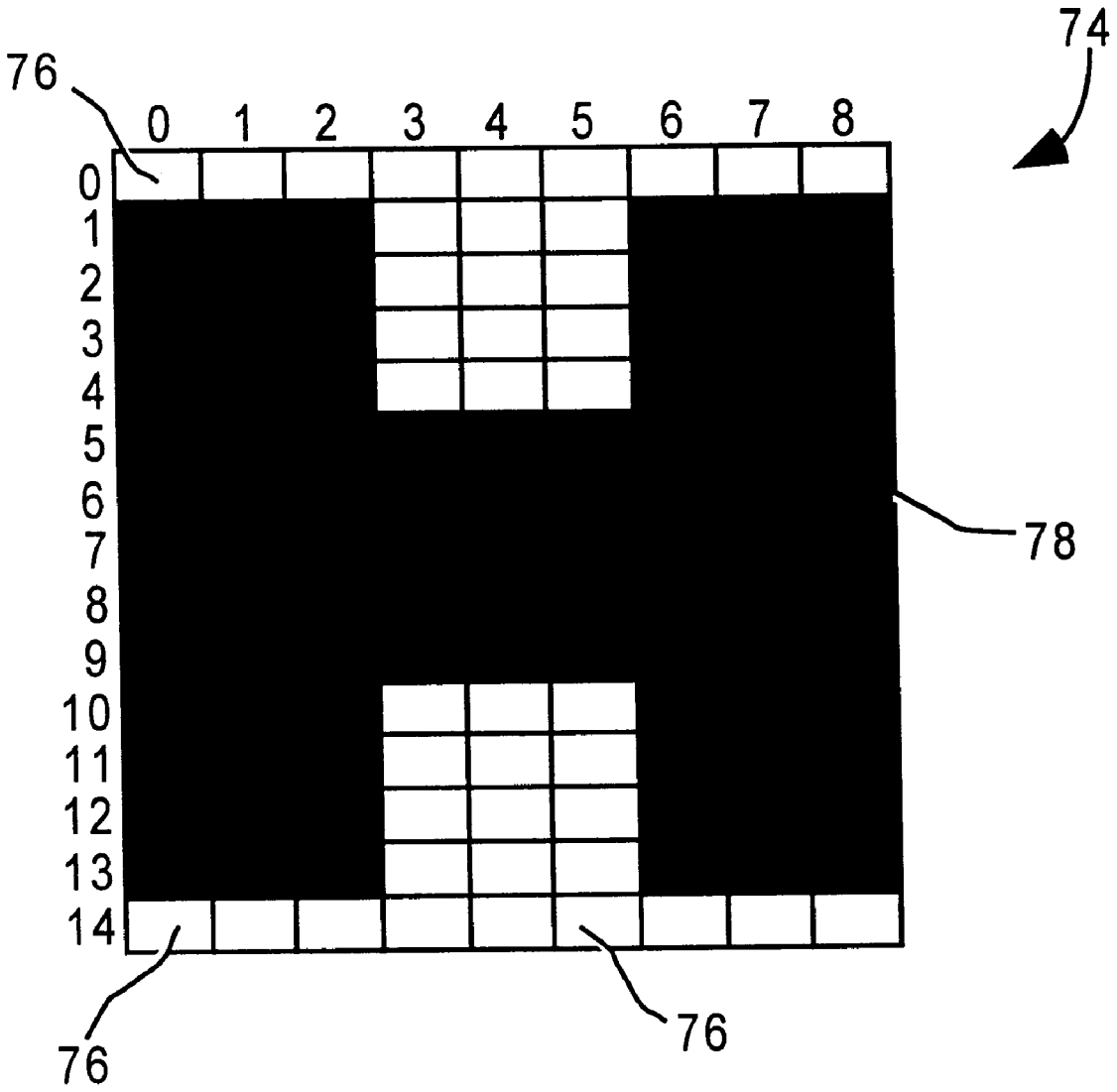
FIG. 6A illustrates an example of a character bitmap in a 9 by 15 pixel format with a representative character ("H") stored therein.

FIG. 6A illustrates an example of a character bitmap 74 in a 9 by 15 pixel format with each square 76 representing a pixel. The character bitmap 74 in this example is an "H" character 78. The character bitmap 74 illustrated in FIG. 6A thus represents an example of a character bitmap for a character stored in the font buffer 24.

Figure 6B:
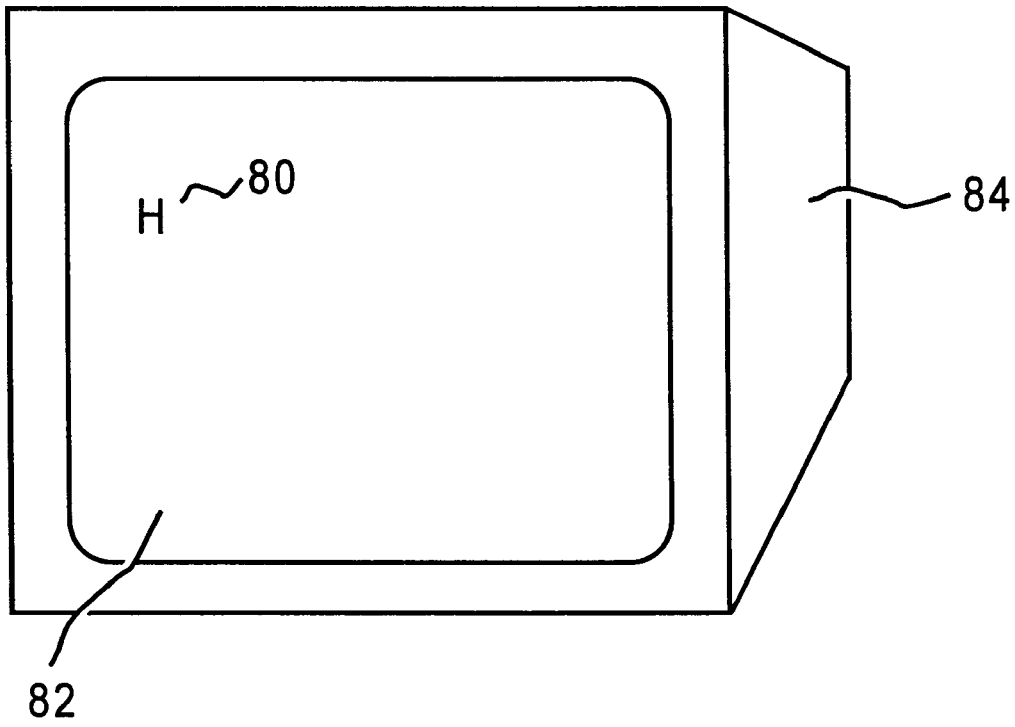
FIG. 6B illustrates display of a character image for a representative character ("H") on a screen of a display device.

In FIG. 6B, the character to be displayed ("H") is illustrated as an "H" character image 80 displayed on a screen 82 of a display device 80. The display of the character image 80 is controlled by the data stored in the frame buffer 40 using techniques well known in the art.

Figure 7A:
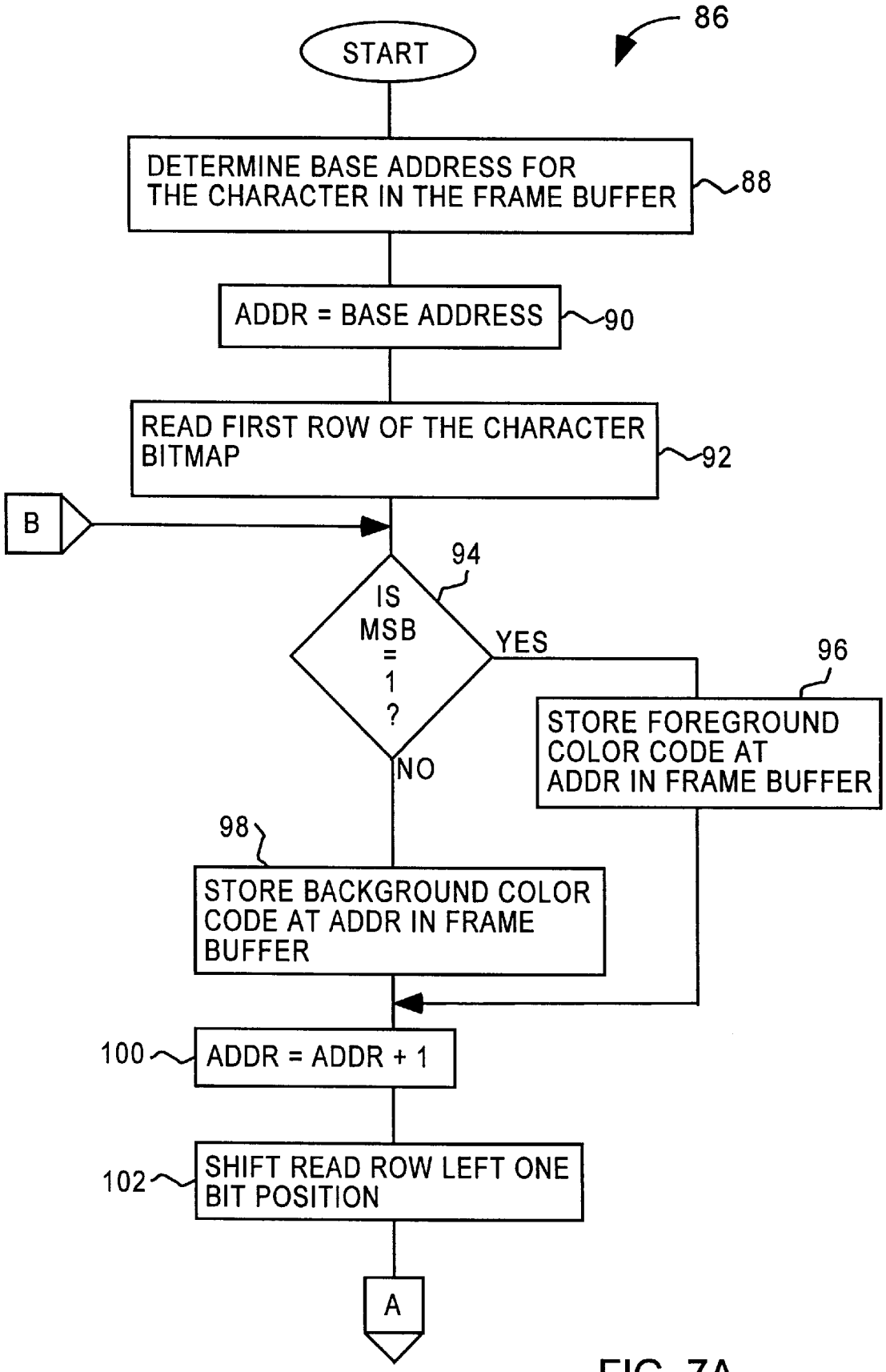
FIGS. 7A and 7B are detailed flowcharts of store operation processing according to an embodiment of the invention.
Figure 7B:
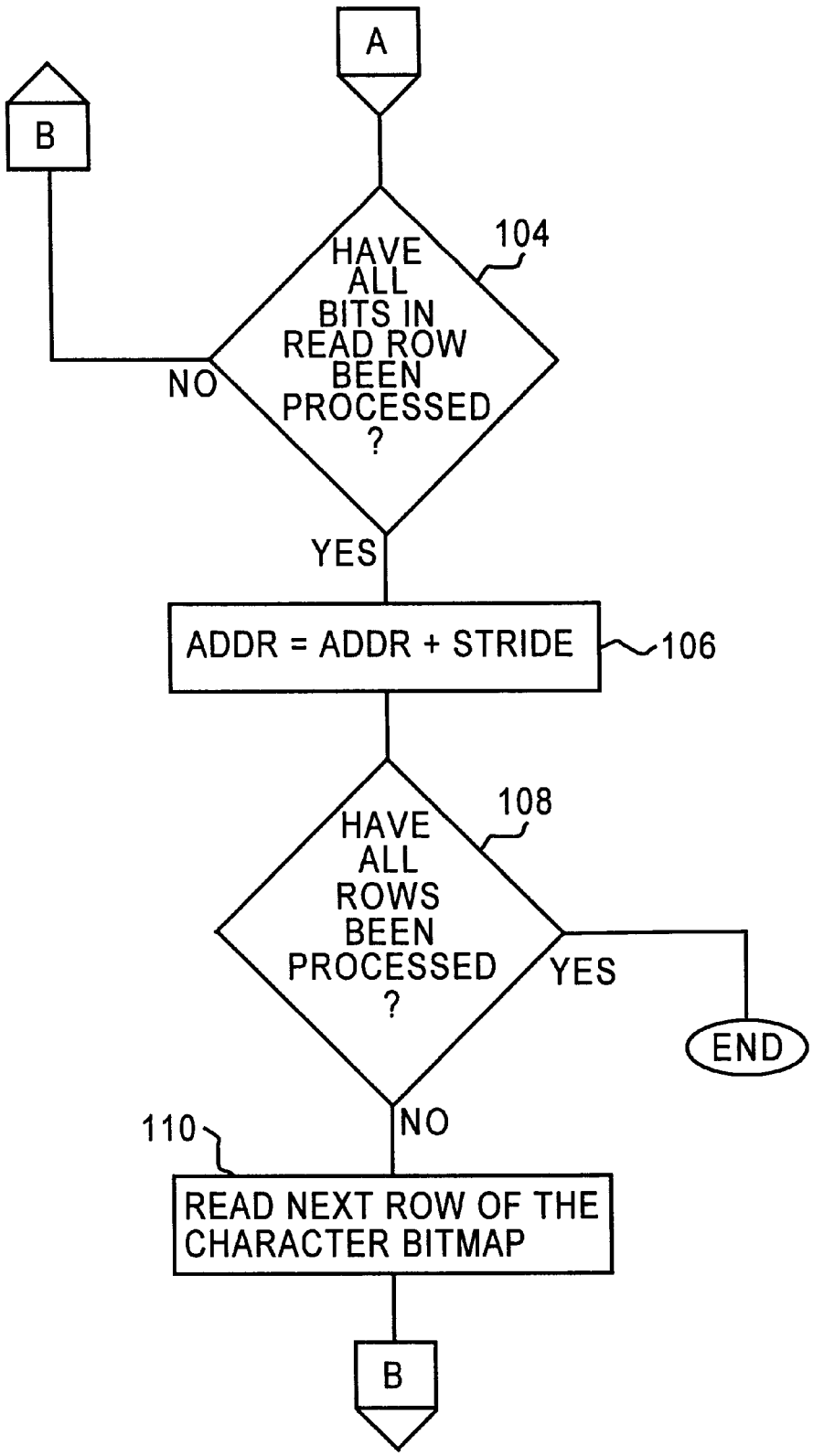

FIGS. 7A and 7B are flowcharts of store operation processing 86 according to an embodiment of the invention. The store operation processing 86 stores the bits of the character bitmap at the appropriate addresses in the frame buffer. The store operation processing 86 represents a detailed embodiment of the store operation 52 of FIG. 3.

Initially, according to the store operation processing 86, a base address for the character in the frame buffer is determined 88. The base address of the character in the frame buffer is generally given by Equation 1 below:

$$row \cdot ((stride_{FB})(Height_Char)) + (column \cdot Width_Char) + Base_Address_{FB} \quad \text{(Eq. 1)}$$

In the exemplary case where the display is 640×480 pixels and the character bitmap in a 8 by 16 pixel format, then the $stride_{FB}$ is 480, the Height_Char is 16, and the Width_Char is 8. The $Base_Address_{FB}$ is the beginning address of the frame buffer.

Next, an address value (ADDR) is set 90 to the base address. The first row of the character bitmap (obtained from the font buffer 24) is read 92. Then, a decision 94 is made based on whether the most significant bit (MSB) is equal to 1. When the MSB is equal to 1, the foreground color code is stored 96 at the address (ADDR) in the frame buffer. Otherwise, when the MSB is not equal to 1, then a background color code is stored 98 at the address (ADDR) in the frame buffer. Note that in this exemplary embodiment, a one ("1") indicates a pixel of the character, whereas a zero ("0") indicates that the pixel is not present in the character. Hence, when the pixel is present the foreground color is displayed, and when the pixel is not present the background color is displayed. The attributes of the draw command are used to determine the particular colors used as the foreground and background colors.

Following either of the blocks 96 or 98, the store operation processing 86 continues by incrementing 100 the address (ADDR) by one. Next, the row of the character bitmap that has been read (i.e., block 92) is shifted 102 left one bit position. Then, a decision 104 is made based on whether all the bits in the row that has been read from the character bitmap (i.e., block 92) have been processed. If all the bits in the row have not yet been processed, the store operation processing 86 returns to repeat block 94 and subsequent blocks so that all the bits are processed.

On the other hand, once all of the bits in the row of the character bitmap have been processed, then the store operation processing 86 proceeds to process another row in the character bitmap. In particular, the address (ADDR) is adjusted 106 to point to the beginning of the next row for the character in the frame buffer. This is achieved by adding a stride amount to the address (ADDR). The stride amount is the number of bytes in a row of the frame buffer. Next, a decision 108 is made based on whether all of the rows of the character bitmap have been processed. If all of the rows of the character bitmap have been processed, then the store operation processing 86 is complete and ends. Otherwise, the next row of the character bitmap is read 110 and processing then repeats block 94 and subsequent blocks until all the rows of the character bitmap have been completely processed.

Thus, in effect, the frame buffer 40 (e.g., a 640×480 pixel grid) is effectively converted into a character grid (e.g., 80×25 character grid) using the character buffer 22. That is, when a request (e.g., Draw request) is made to place a given character at a particular location of the display screen, the given character is placed into the character buffer 22, then the character is converted into a bitmap format and stored into the frame buffer 40, and finally display on the display screen via the frame buffer 40. For a 80×25 character grid, about 4 k bytes of memory storage would be needed for the character buffer 22.

Besides the conversion processing discussed above, the invention is also capable of providing compatibility with several VGA functional features. According to the invention, the above described computer system 2, 14 and operation thereof provide the VGA compatibility required by many operating systems and application programs. The three primary areas of VGA compatibility concern: (i) ability to read characters displayed on a screen, (ii) ability to "flash" of characters on a display screen, and (iii) ability to "flash" a cursor. Each of these areas of compatibility is explained below.

In a computer system that lacks VGA hardware, there is no mechanism to read the characters that are being displayed on a display screen. A simple frame buffer (also known as a pixel buffer) stores bitmaps, not discrete character information. According to the invention, the character buffer 22 is provided and operated in the manner discussed above to maintain an accessible storage region within the computer system wherein the characters being displayed on the display screen can be read. Hence, the first area of VGA compatibility is achieved by the invention.

With respect to the second area of VGA compatibility, a simple frame buffer does not directly support "flashing" of characters. According to the invention, a computer system which lacks VGA hardware is able to "flash" text on a display screen. The technique uses the conversion processing discussed above as well as unique operations with a CLUT. First, to periodically get control to implement the flashing, a VBL interrupt can be utilized. The VBL interrupt, otherwise known as a vertical blank interrupt, occurs when the electron gun in a display screen has reached the bottom right corner, and needs to reset back to the upper left corner of the display screen. The VBL interrupt notifies the microprocessor that the blank is occuring so that the computer system may perform any necessary tasks, such as updating the frame buffer. It is important that this update occurs at VBL time because it helps prevent undesirable visual effects such as image tearing.

Because the redrawing of an entire screen on the display screen or even just redrawing the "flashing" text is far too slow to be acceptable, the CLUT 42 is utilized to rapidly change colors of characters to be "flashed." Thus, according to the invention, "flashing" is achieved by changing the color of the text. Normally, this is done about every ½ second. Preferably, the first bit of the attribute for the character indicates whether the character is to "flash."

However, because we are dealing with color display devices, "flashing" of text causes it to disappear into the background as opposed to simply switching to all black. Hence, a yellow-on-blue character when "flashed," would become blue-on-blue while yellow-on-red would become red-on-red. The two yellows must therefore be different entries in the CLUT 42 so that one can be changed from yellow to blue and back to yellow and the other can be changed from yellow to red and back to yellow.

Since there are eight (8) possible background colors and sixteen (16) possible foreground colors in VGA mode in the display devices, any of the sixteen foreground colors can flash on any of the eight background colors. Also, some characters do not in fact flash. Consequently, a hundred and forty-four (144) entries into the CLUT 42 are required which can be achieved with 8-bit color. The calculation is: (16×8)+16=16×9=144. This assumes that the background colors are a subset of the foreground colors. With 8-bit color, the CLUT 42 can provide RGB values of 24 bits (8 bits for each of red, green and blue) for the display device with a efficient look-up approach. Preferably, the CLUT 42 is an array of 3-byte entries, as follows:

| | | | |
|---|---|---|---|
| 0 | red | green | blue |
| 1 | red | green | blue |
| 2 | red | green | blue |
| . | . | . | . |
| . | . | . | . |
| . | . | . | . |
| 255 | red | green | blue |

Only 144 of these 256 CLUT entries are used by the invention; the rest of the entries are ignored. The first 16 entries are never modified. The remaining 240 entries are changed at a set interval in order to implement flashing.

The foreground colors of the CLUT 42 (the first 16 entries) are set up with RGB values defined by the CGA standard:

| | |
|---|---|
| {0,0,0}, | //black |
| {0,0,170}, | //blue |
| {0,170,0}, | //green |
| {0,170,170}, | //cyan |
| {170,0,0}, | //red |
| {170,0,170}, | //magenta |
| {170,85,0}, | //brown |
| {170,170,170}, | //white |
| {85,85,85}, | //gray |
| {85,85,255}, | //light blue |
| {85,255,85}, | //light green |
| {85,255,255}, | //light cyan |
| {255,85,85}, | //light red |
| {255,85,255}, | //light magenta |
| {240,240,0}, | //yellow |
| {255,255,255}, | //white (high intensity) |

The first eight (8) of these values are used for both background, and foreground colors. The rest of the entries of the CLUT 42 (entries after the first 16 entries) are modified such that, for each background color, 16 foreground color entries are set to be the corresponding colors from the table above for a ½ second interval, then those same 16 entries are set to all be the same as the background color for the next ½ second. Characters whose attributes specify that they are flashing will use these dynamic CLUT entries, and those that do not flash will use the static (first 16) entries.

Representative C++ source code to implement such flashing with the CLUT 42 is as follows:

```
// For all cases . . .
for (bg=1 ;bg<9;bg++)
    for (fg=0;fg<16;fg+++
        if(whichSet==kFlashOnColorSetup)
            ((PDMVideoMgr*)fVideoMgr) -
        >SetColorEntry (bg*16+fg,cgaColors[fg][0],cgaColors[fg][1],cgaColors[fg][2]);
        else // (whichSet==kFlashOffColorSetup)
            ((PDMVideoMgr*)fVideoMgr) -
        >SetColorEntry(bg*16+fg,cgaColors[bg-1][0],cgaColors[bg-1][1],cgaColors[bg-1][2];
```

The VGA functionality also requires that a cursor can be "flashed," which is the third area of compatibility. When the cursor is "flashed" off, the character behind it is visible, and when the cursor is "flashed" on, the cursor is drawn exclusive ORed with the character behind it. Consequently, the "flashing" of the cursor cannot be implemented by changing the color using the CLUT 42. However, since there is only one cursor, it can simply be periodically redrawn without substantial processing overhead. The cursor can be drawn by exclusive-ORing the cursor with the character behind it. The character buffer 22 used for "flashing" other text is not used for "flashing" the cursor. Also, since the "flashing" of the cursor is separate from the "flashing" of text, the rate at which the cursor "flashes" can easily be varied. With conventional VGA mode display devices, there are four bit patterns for cursors: block, underline, top and bottom. These four cursor bit patterns are available in the IBM CGA character set which is preferably stored in the font buffer 64.

The many features and advantages of the present invention are apparent from the written description, and thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. A display system for a computer system having an operating system, said display system having pixel-based display hardware but not character-based display hardware, said display system comprising:

a display device for displaying an image;

a frame buffer for storing a bitmap of the image;

a display driver, operatively connected to said frame buffer and said display device, for causing the bitmap to be forwarded to and displayed on the display device;

a text-mode-to-bitmap conversion system, operatively connected to said frame buffer and the operating system, for converting text characters received from the operating system operating in a text-mode to the bitmap of the image which is stored in said frame buffer, said text-mode-to-bitmap conversion system allows said display system to effectively operate as a character-based display with respect to the operating system even though said display system lacks character-based display hardware;

a color look-up table for converting the bitmap into color codes used to display the image in appropriate colors; and means for flashing at least one of the text characters displayed on said display device when the at least one of the text characters are so designated for flashing by dynamically changing at least a portion of said color look-up table.

2. A display system as recited in claim 1, wherein said display system further comprises character bitmaps stored in memory of the computer system, and wherein said text-mode-to-bitmap conversion system includes at least a character buffer for storing the text characters being or to be displayed on said display device; and a converter for converting the text characters stored in said character buffer into the bitmap for the image.

3. A display system as recited in claim 1, wherein the color codes are stored in said frame buffer.

4. A display system as recited in claim 1, wherein said display system further comprises:

means for flashing a cursor on said display device.

5. A method for providing character-based functionality for a display system that lacks character-based display hardware, the display system being part of a computing device that operates in accordance with an operating system, the display system including a frame buffer, a color look-up table and a display screen, said method comprising:

(a) providing a character buffer for storing the characters being displayed on the display screen;

(b) receiving a display command from the operating system to display a character on the display screen of the display system;

(c) updating the character buffer in accordance with the character identified by the display command;

(d) obtaining a character bitmap for the character;

(e) storing the bits of the character bitmap at appropriate addresses in the frame buffer, said storing (e) includes the acts of converting the bits of the character bitmap into color codes, and storing the color codes at the appropriate addresses in the frame buffer; and (f) dynamically changing a portion of the color codes to provide for flashing a least one of the characters displayed on the display screen.

6. A method as recited in claim 5, wherein the display system has bitmap display hardware, such that the frame buffer is required to store a bitmap.

7. A method as recited in claim 5, wherein the display command is from an operating system that operates in a character-based mode.

8. A method as recited in claim 5, wherein the character-based functionality for the display system provided by said method is VGA functionality, and the display system that lacks VGA hardware.

9. A method as recited in claim 5, wherein said method further comprises:

(g) retrieving the color codes stored in the frame buffer;

(h) converting the color codes to RGB values; and (i) supplying the RGB values to the display screen to produce an image thereon.

10. A method as recited in claim 9, wherein the image produced on the display screen by said supplying (i) includes the character from the display command.

11. A display system having pixel-based display hardware but not character-based display hardware, said display system comprising:

a display screen for displaying an image;

a frame buffer for storing bit data of the image;

a character buffer for storing the characters being displayed on the display screen;

receive means for receiving a display command to display a character on the display screen;

update means for updating the character buffer in accordance with the character identified by the display command;

retrieval means for obtaining a character bitmap for the character;

merge means for merging the bit data of the character bitmap with the bit data in the frame buffer;

a color look-up table for storing color codes for a plurality of colors;

means for converting the bit data of the image stored in said frame buffer into color codes using said color look-up table; and means for dynamically changing a portion of said color look-up table to provide for flashing certain of the characters displayed on said display screen when the certain of the characters are so designated for flashing.

12. A display system as recited in claim 11, wherein said merge means stores the bit data of the character bitmap into at appropriate addresses in the frame buffer.

13. A display system as recited in claim 11, wherein said frame buffer stores the bit data of the image on a pixel-by-pixel basis.

14. A display system as recited in claim 11, wherein said display system further comprises:

means for flashing a cursor on said display device.

* * * * *